US008381940B2

(12) United States Patent
Melrose et al.

(10) Patent No.: US 8,381,940 B2
(45) **Date of Patent: *Feb. 26, 2013**

(54) PRESSURE REINFORCED PLASTIC CONTAINER HAVING A MOVEABLE PRESSURE PANEL AND RELATED METHOD OF PROCESSING A PLASTIC CONTAINER

(75) Inventors: David Melrose, Mount Eden (NZ); Paul Kelley, Wrightsville, PA (US); John Denner, York, PA (US)

(73) Assignee: Co2 Pac Limited, Auckland (NZ)

( * ) Notice: Subject to any disclaimer, the term of this patent is extended or adjusted under 35 U.S.C. 154(b) by 742 days.

This patent is subject to a terminal disclaimer.

(21) Appl. No.: 11/413,124

(22) Filed: Apr. 28, 2006

(65) Prior Publication Data

US 2006/0255005 A1 Nov. 16, 2006

Related U.S. Application Data

(63) Continuation-in-part of application No. 10/529,198, filed as application No. PCT/NZ03/00220 on Sep. 30, 2003, now Pat. No. 8,152,010, application No. 11/413,124, which is a continuation-in-part of application No. 10/566,294, filed as application No.

(Continued)

(30) Foreign Application Priority Data

Sep. 30, 2002 (NZ) ..... 521694

(51) Int. Cl.
*B65D 90/02* (2006.01)
*B65D 8/08* (2006.01)
*B65D 8/12* (2006.01)

(52) U.S. Cl. ..... 220/609; 215/371; 215/381; 215/384; 220/720

(58) Field of Classification Search ..... 215/371–375, 215/381–384; 220/609, 624, 721
See application file for complete search history.

(56) References Cited

U.S. PATENT DOCUMENTS (Continued)

FOREIGN PATENT DOCUMENTS

| | | |
|---|---|---|
| CA | 2077717 | 3/1993 |
| DE | 17 61 753 | 1/1972 |

(Continued)

OTHER PUBLICATIONS

IPRP for PCT/NZ03/00220, completed Jan. 11, 2005.

(Continued)

*Primary Examiner* — J. Gregory Pickett
*Assistant Examiner* — Ned A Walker
(74) *Attorney, Agent, or Firm* — Venable LLP; Keith G. Haddaway; Ryan M. Flandro

(57) ABSTRACT

A plastic container comprises an upper portion including a finish adapted to receive a closure, a lower portion including a base, and a sidewall extending between the upper portion and the lower portion. The upper portion, the lower portion, and the sidewall define an interior volume for storing liquid contents. The plastic container further comprises a pressure panel located on the container and moveable between an initial position and an activated position. The pressure panel is located in the initial position prior to filling the container, and is moved to the activated position after filling and sealing the container. Moving the pressure panel from the initial position to the activated position reduces the internal volume of the container and creates a positive pressure inside the container. The positive pressure reinforces the sidewall. A method of processing a container is also disclosed.

24 Claims, 9 Drawing Sheets

Related U.S. Application Data

PCT/US2004/024581 on Jul. 30, 2004, now Pat. No. 7,726,106.

(60) Provisional application No. 60/491,179, filed on Jul. 30, 2003, provisional application No. 60/551,771, filed on Mar. 11, 2004.

(56) References Cited

U.S. PATENT DOCUMENTS 1,499,239 A * 6/1924 Malmquist ..... 220/624
D110,624 S 7/1938 Mekeel, Jr.
2,124,959 A * 7/1938 Vogel ..... 53/471
2,378,324 A 6/1945 Ray et al.
2,880,902 A 4/1959 Owsen
2,960,248 A 11/1960 Kuhlman
2,971,671 A * 2/1961 Shakman ..... 220/624
2,982,440 A * 5/1961 Harrison ..... 220/609
3,043,461 A * 7/1962 Glassco ..... 215/375
3,081,002 A 3/1963 Tauschinski et al.
3,174,655 A 3/1965 Hurschman
3,301,293 A 1/1967 Santelli
3,397,724 A 8/1968 Bolen et al.
3,409,167 A 11/1968 Blanchard
3,426,939 A * 2/1969 Young ..... 220/609
3,468,443 A 9/1969 Marcus
3,483,908 A 12/1969 Donovan
3,485,355 A 12/1969 Stewart
3,693,828 A 9/1972 Kneusel et al.
3,704,140 A 11/1972 Petit et al.
3,727,783 A 4/1973 Carmichael
3,819,789 A 6/1974 Parker
3,904,069 A * 9/1975 Toukmanian ..... 220/609
3,918,920 A 11/1975 Barber
3,935,955 A 2/1976 Das
3,941,237 A 3/1976 MacGregor
3,942,673 A 3/1976 Lyu et al.
3,949,033 A 4/1976 Uhlig
4,036,926 A 7/1977 Chang
4,117,062 A 9/1978 Uhlig
4,125,632 A 11/1978 Vosti et al.
4,134,510 A 1/1979 Chang
4,170,622 A 10/1979 Uhlig et al.
4,174,782 A 11/1979 Obsomer
4,219,137 A 8/1980 Hutchens
4,231,483 A 11/1980 Dechenne et al.
4,247,012 A * 1/1981 Alberghini ..... 215/373
4,301,933 A 11/1981 Yoshino et al.
4,318,489 A 3/1982 Snyder et al.
4,318,882 A * 3/1982 Agrawal et al. ..... 264/521
4,321,483 A 3/1982 Dugan
4,338,765 A * 7/1982 Ohmori et al. ..... 53/452
4,355,728 A 10/1982 Ota et al.
4,377,191 A 3/1983 Yamaguchi
4,378,328 A 3/1983 Przytulla
4,381,061 A * 4/1983 Cerny et al. ..... 220/62.11
D269,158 S 5/1983 Gaunt et al.
4,386,701 A 6/1983 Galer
4,412,866 A 11/1983 Schoenrock et al.
4,436,216 A 3/1984 Chang
4,444,308 A * 4/1984 MacEwen ..... 206/249
4,450,878 A 5/1984 Takada et al.
4,465,199 A 8/1984 Aoki
4,497,855 A * 2/1985 Agrawal et al. ..... 428/36.92
4,542,029 A * 9/1985 Caner et al. ..... 426/127
4,610,366 A 9/1986 Estes et al.
4,628,669 A 12/1986 Herron et al.
4,642,968 A 2/1987 McHenry et al.
4,645,078 A 2/1987 Reyner
4,667,454 A 5/1987 McHenry et al.
4,684,025 A 8/1987 Copland et al.
4,685,273 A * 8/1987 Caner et al. ..... 53/440
D292,378 S 10/1987 Brandt et al.
4,749,092 A 6/1988 Sugiura et al.
4,773,458 A 9/1988 Touzani
4,785,949 A 11/1988 Krishnakumar et al.
4,785,950 A 11/1988 Miller et al.
4,807,424 A 2/1989 Robinson et al.
4,813,556 A 3/1989 Lawrence
4,831,050 A 5/1989 Bettle
4,836,398 A 6/1989 Leftault, Jr. et al.
4,850,493 A 7/1989 Howard, Jr.
4,850,494 A 7/1989 Howard, Jr.
4,865,206 A * 9/1989 Behm et al. ..... 215/375
4,867,323 A 9/1989 Powers
4,880,129 A * 11/1989 McHenry et al. ..... 220/609
4,887,730 A 12/1989 Touzani
4,892,205 A 1/1990 Powers et al.
4,896,205 A 1/1990 Weber
4,921,147 A 5/1990 Poirier
4,967,538 A 11/1990 Leftault et al.
4,976,538 A 12/1990 Ake
4,978,015 A 12/1990 Walker
4,997,692 A 3/1991 Yoshino
5,004,109 A 4/1991 Bartley
5,005,716 A * 4/1991 Eberle ..... 215/373
5,014,868 A 5/1991 Wittig et al.
5,024,340 A 6/1991 Alberghini et al.
5,060,453 A * 10/1991 Alberghini et al. ..... 53/440
5,067,622 A 11/1991 Garver et al.
5,090,180 A 2/1992 Sorensen
5,092,474 A 3/1992 Leigner
5,133,468 A 7/1992 Brunson et al.
5,141,121 A 8/1992 Brown et al.
5,178,290 A 1/1993 Ota et al.
5,199,587 A 4/1993 Ota et al.
5,199,588 A 4/1993 Hayashi
5,201,438 A 4/1993 Norwood et al.
5,217,737 A 6/1993 Gygax et al.
5,234,126 A * 8/1993 Jonas et al. ..... 220/609
5,244,106 A 9/1993 Takacs
5,251,424 A 10/1993 Zenger et al.
5,255,889 A 10/1993 Collette et al.
5,261,544 A 11/1993 Weaver, Jr.
5,279,433 A 1/1994 Krishnakumar et al.
5,281,387 A 1/1994 Collette et al.
5,333,761 A 8/1994 Davis et al.
5,341,946 A 8/1994 Vailliencourt et al.
5,392,937 A 2/1995 Prevot
5,411,699 A 5/1995 Collette et al.
5,454,481 A * 10/1995 Hsu ..... 220/608
5,472,105 A 12/1995 Krishnakumar et al.
5,472,181 A 12/1995 Lowell
RE35,140 E 1/1996 Powers, Jr.
5,484,052 A 1/1996 Pawloski et al.
5,503,283 A 4/1996 Semersky
5,598,941 A 2/1997 Semersky
5,632,397 A 5/1997 Fandeux et al.
5,642,826 A 7/1997 Melrose
5,672,730 A 9/1997 Cottman
5,690,244 A 11/1997 Darr
5,704,504 A 1/1998 Bueno
5,713,480 A 2/1998 Petre et al.
5,730,314 A 3/1998 Wiemann et al.
5,730,914 A 3/1998 Ruppmann, Sr.
5,737,827 A 4/1998 Kuse et al.
5,758,802 A 6/1998 Wallays
5,762,221 A 6/1998 Tobias et al.
5,780,130 A 7/1998 Hansen et al.
5,785,197 A 7/1998 Slat
5,829,614 A 11/1998 Collette et al.
5,858,300 A 1/1999 Shimizu et al.
5,860,556 A 1/1999 Robbins, III
5,887,739 A 3/1999 Prevot et al.
5,888,598 A 3/1999 Brewster et al.
5,897,090 A 4/1999 Smith et al.
5,906,286 A 5/1999 Matsuno et al.
5,908,128 A * 6/1999 Krishnakumar et al. ..... 215/381
D415,030 S 10/1999 Searle et al.
5,976,653 A 11/1999 Collette et al.
RE36,639 E 4/2000 Okhai
6,065,624 A 5/2000 Steinke
6,077,554 A * 6/2000 Wiemann et al. ..... 426/397
6,105,815 A 8/2000 Mazda et al.
6,213,325 B1 4/2001 Cheng et al.

| | | | | |
|---|---|---|---|---|
| 6,228,317 | B1 | 5/2001 | Smith et al. | |
| 6,230,912 | B1 | 5/2001 | Rashid | |
| 6,277,321 | B1 | 8/2001 | Vailliencourt et al. | |
| 6,298,638 | B1 | 10/2001 | Bettle | |
| 6,375,025 | B1 | 4/2002 | Mooney | |
| 6,390,316 | B1 | 5/2002 | Mooney | |
| 6,413,466 | B1 | 7/2002 | Boyd et al. | |
| 6,439,413 | B1 | 8/2002 | Prevot | |
| 6,467,639 | B2 | 10/2002 | Mooney | |
| 6,485,669 | B1 | 11/2002 | Boyd et al. | |
| 6,502,369 | B1 | 1/2003 | Andison et al. | |
| 6,514,451 | B1 | 2/2003 | Boyd et al. | |
| 6,585,124 | B2 | 7/2003 | Boyd et al. | |
| 6,595,380 | B2 * | 7/2003 | Silvers | 215/373 |
| 6,612,451 | B2 | 9/2003 | Tobias et al. | |
| 6,662,960 | B2 * | 12/2003 | Hong et al. | 215/381 |
| 6,749,780 | B2 | 6/2004 | Tobias | |
| 6,769,561 | B2 * | 8/2004 | Futral et al. | 215/373 |
| 6,779,673 | B2 * | 8/2004 | Melrose et al. | 215/381 |
| 6,923,334 | B2 * | 8/2005 | Melrose et al. | 215/381 |
| 6,942,116 | B2 | 9/2005 | Lisch et al. | |
| 6,983,858 | B2 * | 1/2006 | Slat et al. | 215/373 |
| 7,051,889 | B2 | 5/2006 | Boukobza | |
| 7,077,279 | B2 * | 7/2006 | Melrose | 215/381 |
| 7,137,520 | B1 * | 11/2006 | Melrose | 215/381 |
| 7,150,372 | B2 | 12/2006 | Lisch et al. | |
| 7,159,374 | B2 | 1/2007 | Abercrombie, III et al. | |
| 7,520,400 | B2 * | 4/2009 | Young et al. | 215/375 |
| 2001/0035391 | A1 | 11/2001 | Young et al. | |
| 2002/0074336 | A1 | 6/2002 | Silvers | |
| 2002/0096486 | A1 | 7/2002 | Bourque et al. | |
| 2002/0153343 | A1 | 10/2002 | Tobias et al. | |
| 2002/0158038 | A1 | 10/2002 | Heisel et al. | |
| 2003/0015491 | A1 * | 1/2003 | Melrose et al. | 215/381 |
| 2003/0186006 | A1 | 10/2003 | Schmidt et al. | |
| 2003/0196926 | A1 | 10/2003 | Tobias et al. | |
| 2003/0217947 | A1 | 11/2003 | Ishikawa et al. | |
| 2004/0016716 | A1 * | 1/2004 | Melrose et al. | 215/381 |
| 2004/0028910 | A1 | 2/2004 | Yamamoto et al. | |
| 2004/0074864 | A1 | 4/2004 | Melrose et al. | |
| 2004/0149677 | A1 | 8/2004 | Slat et al. | |
| 2004/0173565 | A1 | 9/2004 | Semersky et al. | |
| 2004/0173656 | A1 | 9/2004 | Seong | |
| 2004/0211746 | A1 | 10/2004 | Trude | |
| 2004/0232103 | A1 * | 11/2004 | Lisch et al. | 215/374 |
| 2006/0006133 | A1 | 1/2006 | Lisch et al. | |
| 2006/0138074 | A1 | 6/2006 | Melrose | |
| 2006/0231985 | A1 | 10/2006 | Kelley | |
| 2006/0243698 | A1 * | 11/2006 | Melrose | 215/381 |
| 2006/0255005 | A1 | 11/2006 | Melrose et al. | |
| 2006/0261031 | A1 * | 11/2006 | Melrose | 215/381 |
| 2007/0017892 | A1 * | 1/2007 | Melrose | 215/381 |
| 2007/0045312 | A1 | 3/2007 | Abercrombie, III et al. | |
| 2007/0051073 | A1 | 3/2007 | Kelley et al. | |
| 2007/0084821 | A1 | 4/2007 | Bysick et al. | |
| 2007/0125743 | A1 | 6/2007 | Pritchett et al. | |
| 2007/0181403 | A1 | 8/2007 | Sheets et al. | |
| 2007/0199915 | A1 | 8/2007 | Denner et al. | |
| 2007/0199916 | A1 | 8/2007 | Denner et al. | |
| 2007/0215571 | A1 | 9/2007 | Trude | |
| 2007/0235905 | A1 | 10/2007 | Trude et al. | |
| 2008/0047964 | A1 * | 2/2008 | Denner et al. | 220/624 |

FOREIGN PATENT DOCUMENTS

| | | | |
|---|---|---|---|
| DE | 21 02 319 | A1 | 8/1972 |
| DE | 2102319 | | 8/1972 |
| DE | 32 15 866 | | 11/1983 |
| EP | 0 521 642 | | 1/1993 |
| EP | 0 666 222 | | 8/1995 |
| EP | 0 957 030 | A2 | 11/1999 |
| EP | 1 063 076 | | 12/2000 |
| FR | 1571499 | | 6/1969 |
| FR | 2607109 | | 5/1988 |
| GB | 781103 | | 8/1957 |
| GB | 1113988 | | 5/1968 |
| GB | 2050919 | | 1/1981 |
| GB | 2 372 977 | A | 9/2002 |
| JP | 49-28628 | | 7/1974 |
| JP | 56-72730 | | 6/1981 |
| JP | 55-114717 | | 2/1982 |
| JP | 63-189224 | | 8/1988 |
| JP | 64-009146 | | 1/1989 |
| JP | 03-043342 | | 2/1991 |
| JP | 03-076625 | | 4/1991 |
| JP | 05-193694 | | 8/1993 |
| JP | 06-336238 | | 12/1994 |
| JP | 07-300121 | | 11/1995 |
| JP | 8053115 | A | 2/1996 |
| JP | 08-253220 | | 10/1996 |
| JP | 09-039934 | | 2/1997 |
| JP | 09-110045 | | 4/1997 |
| JP | 10-167226 | | 6/1998 |
| JP | 10-181734 | | 7/1998 |
| JP | 10-230919 | | 9/1998 |
| JP | 2000-168756 | A | 6/2000 |
| JP | 2000-229615 | | 8/2000 |
| JP | 2002-127237 | | 5/2002 |
| JP | 2006-501109 | | 1/2006 |
| NZ | 240448 | | 6/1995 |
| NZ | 296014 | | 10/1998 |
| NZ | 335565 | | 10/1999 |
| NZ | 506684 | | 8/2000 |
| NZ | 512423 | | 6/2001 |
| NZ | 521694 | | 10/2003 |
| WO | WO 93/09031 | | 5/1993 |
| WO | WO 93/12975 | | 7/1993 |
| WO | WO 94/05555 | | 3/1994 |
| WO | WO 97/14617 | | 4/1997 |
| WO | WO 97/34808 | | 9/1997 |
| WO | WO 99/21770 | | 5/1999 |
| WO | WO 01/40081 | | 12/1999 |
| WO | WO 00/51895 | | 9/2000 |
| WO | WO 02/02418 | | 1/2002 |
| WO | WO 02/18213 | | 3/2002 |
| WO | WO 02/085755 | | 10/2002 |
| WO | WO 2004/028910 | A | 4/2004 |
| WO | WO 2004/106175 | | 12/2004 |
| WO | WO 2004/106176 | | 12/2004 |
| WO | WO 2005/012091 | | 2/2005 |
| WO | WO 2007/127337 | | 11/2007 |

OTHER PUBLICATIONS

IPRP with Written Opinion for PCT/US2004/024581, Jan. 30, 2006.
IPRP with Written Opinion for PCT/US2007/010182, Oct. 28, 2008.
ISR for PCT/NZ03/00220, mailed Nov. 27, 2003.
ISR for PCT/US2004/024581, Jul. 25, 2005.
ISR for PCT/US2007/010182, Oct. 19, 2007.
State Intellectual Property Office of People's Republic of China Notification of the First Office Action, dated Mar. 23, 2010, issued in connection with counterpart Chinese Patent Application No. 200780022545.0.
Notice of Rejection of Japanese Patent Application No. 2002-523347, dated May 24, 2011.
Communication from the European Patent Office, dated Dec. 8, 2011, issued in connection with counterpart European Patent Application No. 07 794 381.9.
Office Action for European Application No. 07 794 381.9 dated Nov. 21, 2012.

* cited by examiner

PRESSURE REINFORCED PLASTIC CONTAINER HAVING A MOVEABLE PRESSURE PANEL AND RELATED METHOD OF PROCESSING A PLASTIC CONTAINER

CROSS-REFERENCE TO RELATED APPLICATIONS

The present application is a continuation-in-part of U.S. patent application Ser. No. 10/529,198, filed on Dec. 15, 2005, which is the U.S. National Phase of International Application No. PCT/NZ2003/000220, filed on Sep. 30, 2003, which claims priority of New Zealand Application No. 521694, filed on Sep. 30, 2002. The present application is also a continuation-in-part of U.S. patent application Ser. No. 10/566,294, filed on Jan. 27, 2006, which is the U.S. National Phase of International Application No. PCT/US2004/024581, filed on Jul. 30, 2004, which claims priority of U.S. Provisional Patent Application No. 60/551,771, filed Mar. 11, 2004, and U.S. Provisional Patent Application No. 60/491,179, filed Jul. 30, 2003. The entire contents of the aforementioned applications are incorporated herein by reference.

BACKGROUND OF THE INVENTION

1. Field of the Invention

The present invention relates generally to plastic containers, and more specifically, to plastic containers in which the contents are pressurized to reinforce the walls of the containers.

2. Related Art

In order to achieve the strength characteristics of a glass bottle, conventional lightweight plastic containers are typically provided with rib structures, recessed waists, or other structures that reinforce the sidewall of the container. While known reinforcing structures usually provide the necessary strength, they tend to clutter the sidewall of the container and detract from the desired smooth, sleek appearance of a glass container. In addition, the known reinforcing structures often limit the number of shapes and configurations that are available to bottle designers. Thus, there remains a need in the art for a relatively lightweight plastic container that has the strength characteristics of a glass container as well as the smooth, sleek appearance of a glass container, and offers increased design opportunities.

BRIEF SUMMARY OF THE INVENTION

In summary, the present invention is directed to a plastic container having a structure that reduces the internal volume of the container in order to create a positive pressure inside the container. The positive pressure inside the container serves to reinforce the container, thereby reducing the need for reinforcing structures such as ribs in the sidewall. This allows the plastic container to have the approximate strength characteristics of a glass container and at the same time maintain the smooth, sleek appearance of a glass container.

In one exemplary embodiment, the present invention provides a plastic container comprising an upper portion including a finish adapted to receive a closure, a lower portion including a base, a sidewall extending between the upper portion and the lower portion, wherein the upper portion, the lower portion, and the sidewall define an interior volume for storing liquid contents. A pressure panel is located on the container and is moveable between an initial position and an activated position, wherein the pressure panel is located in the initial position prior to filling the container and is moved to the activated position after filling and sealing the container. Moving the pressure panel from the initial position to the activated position reduces the internal volume of the container and creates a positive pressure inside the container. The positive pressure reinforces the sidewall.

According to another exemplary embodiment, the present invention provides a plastic container comprising an upper portion having a finish adapted to receive a closure, a lower portion including a base, and a sidewall extending between the upper portion and the lower portion, a substantial portion of the sidewall being free of structural reinforcement elements, and a pressure panel located on the container and moveable between an initial position and an activated position. After the container is filled and sealed, the sidewall is relatively flexible when the pressure panel is in the initial position, and the sidewall becomes relatively stiffer after the pressure panel is moved to the activated position.

According to yet another exemplary embodiment, the present invention provides a method of processing a container comprising providing a container comprising a sidewall and a pressure panel, the container defining an internal volume, filling the container with a liquid contents, capping the container to seal the liquid contents inside the container, and moving the pressure panel from an initial position to an activated position in which the pressure panel reduces the internal volume of the container, thereby creating a positive pressure inside the container that reinforces the sidewall.

Further objectives and advantages, as well as the structure and function of preferred embodiments, will become apparent from a consideration of the description, drawings, and examples.

BRIEF DESCRIPTION OF THE DRAWINGS

The foregoing and other features and advantages of the invention will be apparent from the following, more particular description of a preferred embodiment of the invention, as illustrated in the accompanying drawings wherein like reference numbers generally indicate identical, functionally similar, and/or structurally similar elements.

DETAILED DESCRIPTION OF THE INVENTION

Figure 1:
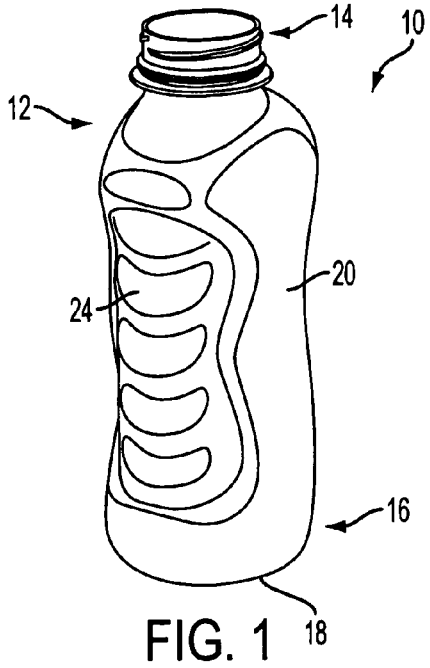
FIG. 1 is a perspective view of an exemplary embodiment of a plastic container according to the present invention.
Figure 2:
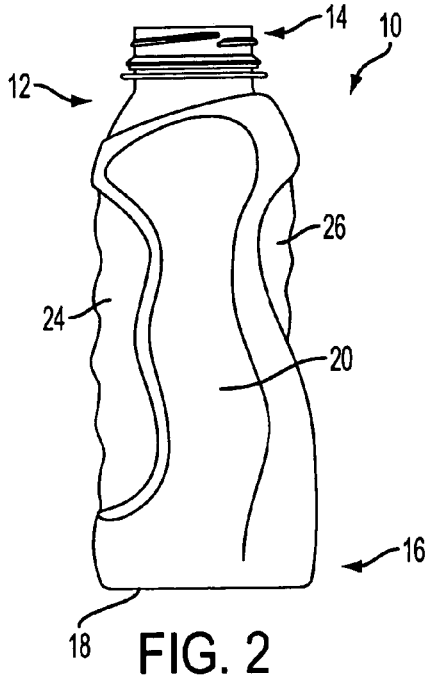
FIG. 2 is a side view of the plastic container of FIG. 1.
Figure 3:
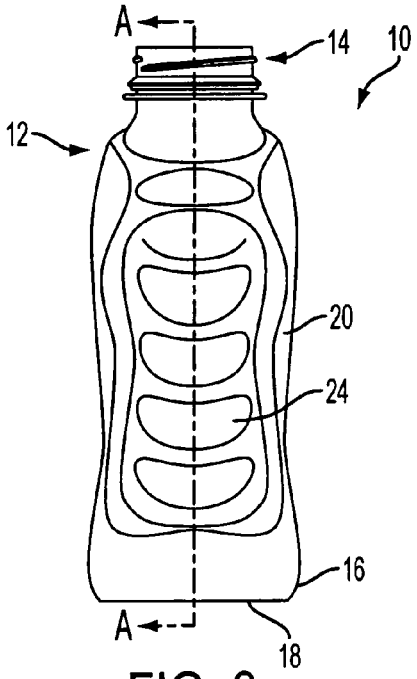
FIG. 3 is a front view of the plastic container of FIG. 1.

Embodiments of the invention are discussed in detail below. In describing embodiments, specific terminology is employed for the sake of clarity. However, the invention is not intended to be limited to the specific terminology so selected. While specific exemplary embodiments are discussed, it should be understood that this is done for illustration purposes only. A person skilled in the relevant art will recognize that other components and configurations can be used without departing from the spirit and scope of the invention. All references cited herein are incorporated by reference as if each had been individually incorporated.

The present invention relates to a plastic container having one or more structures that allow the internal volume of the container to be reduced after the container has been filled and sealed. Reducing the internal volume of the container may result in an increase in pressure inside the container, for example, by compressing the headspace of the filled container. The pressure increase inside the container can have the effect of strengthening the container, for example, increasing the container's top-load capacity or hoop strength. The pressure increase can also help ward off deformation of the container that may occur over time, for example, as the container loses pressure due to vapor loss. In addition, the reduction in internal volume can be adjusted to compensate for the internal vacuum that often develops in hot-filled containers as a result of the cooling of the liquid contents after filling and capping. As a result, plastic containers according to the present invention can be designed with relatively less structural reinforcing elements than prior art containers. For example, plastic containers according to the present invention may have fewer reinforcing elements in the sidewall as compared to prior art designs.

Referring to FIGS. 1-4, an exemplary container embodying the principles of the present invention is shown. Container 10 generally includes an upper portion 12 including a finish 14 adapted to receive a closure, such as a cap or a spout. Container 10 also includes a lower portion 16 including a base 18, which may be adapted to support container 10, for example, in an upright position on a generally smooth surface. A sidewall 20 extends between the upper portion 12 and the lower portion 16. The upper portion 12, lower portion 16, and sidewall 20 generally define an interior volume of container 10, which can store liquid contents, such as juices or other beverages. According to one exemplary embodiment of the invention, the liquid contents can be hot filled, as will be described in more detail below. Container 10 is typically blow molded from a plastic material, such as a thermoplastic polyester resin, for example, PET (polyethylene terephthalate), or polyolefins, such as PP and PE, although other materials and methods of manufacture are possible.

Figure 4:
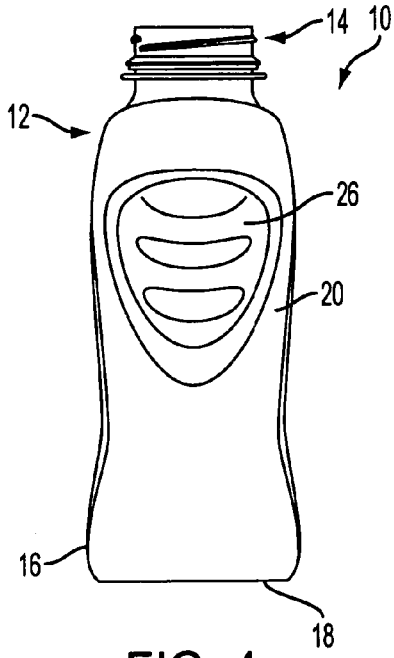
FIG. 4 is a rear view of the plastic container of FIG. 1.
Figure 5:
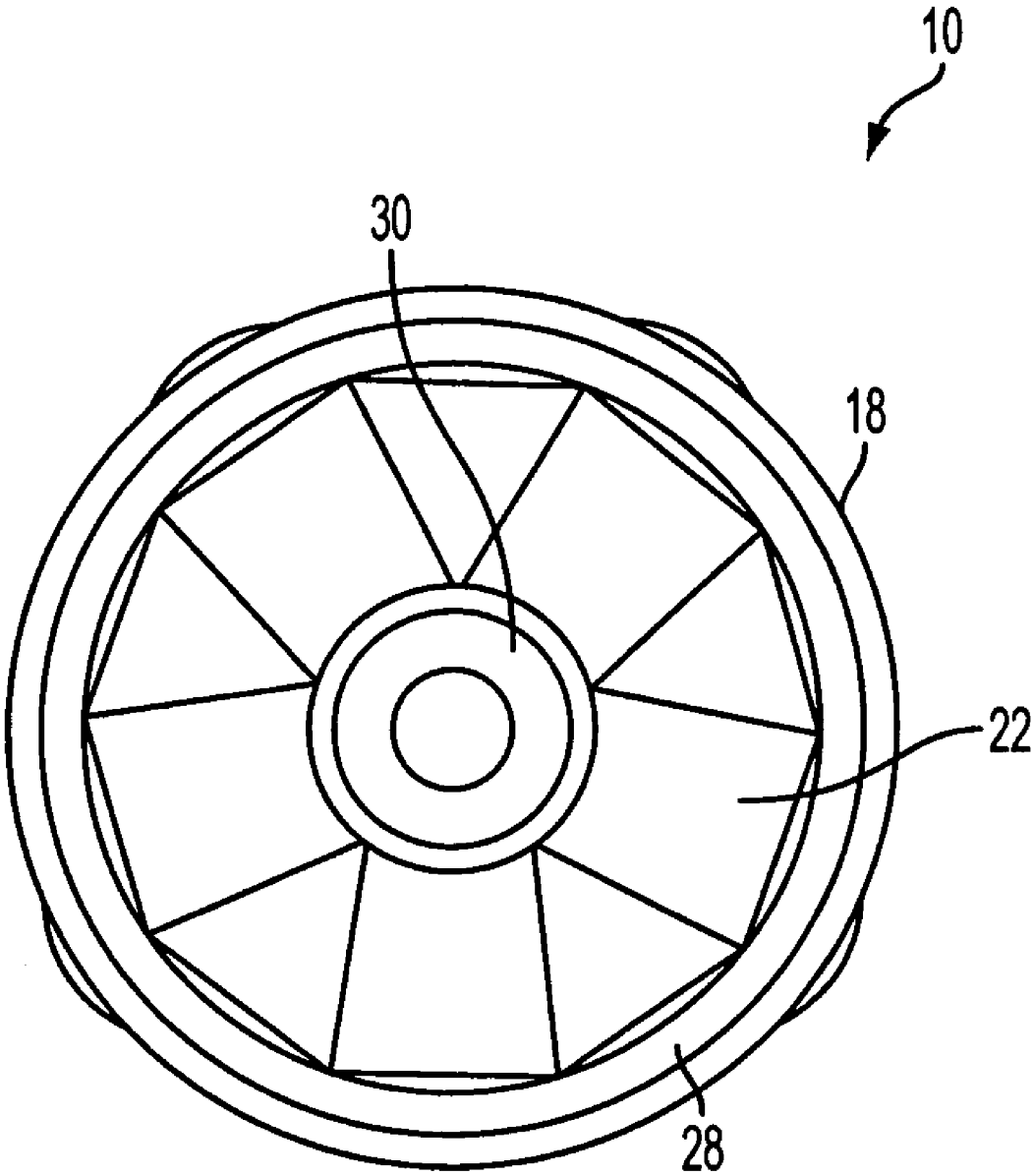
FIG. 5 is a bottom view of the plastic container of FIG. 1.

Referring to FIG. 5, base 18, or some other portion of container 10, can include a pressure panel 22. Pressure panel 22 can be activated to reduce the internal volume of the container 10 once it is filled and sealed, thereby creating a positive pressure inside container 10. For example, activating pressure panel 22 can serve to compress the headspace of the container (i.e., the portion of the container that is not occupied by liquid contents). Based on the configuration of the pressure panel 22, the shape of container 10, and/or the thickness of sidewall 20, the positive pressure inside container 10 can be sufficiently large to reinforce container 10, and more specifically, sidewall 20. As a result, and as shown in FIGS. 1-4, sidewall 20 can remain relatively thin and still have at least a substantial portion that is free of known structural reinforcement elements (such as ribs) that were previously considered necessary to strengthen containers, and which can detract from the sleek appearance of containers.

Referring to FIGS. 1-4, sidewall 20 can have a generally circular cross-section, although other known cross-sections are possible. The portions of the sidewall 20 that are free of structural reinforcement elements may have ornamental features, such as dimples, textures, or etchings. Additionally or alternatively, sidewall 20 can include one or more grip panels, for example, first grip panel 24 and second grip panel 26. It is known in the prior art for grip panels to serve as reinforcement elements, however, this may not be necessary with grip panels 24, 26 if the pressure panel 22 is configured to provide sufficient pressure inside container 10. Accordingly, simplified grip panels (e.g., without stiff rib structures) may be provided that do not serve as reinforcement elements, or that do so to a lesser extent than with prior art containers.

Figure 6:
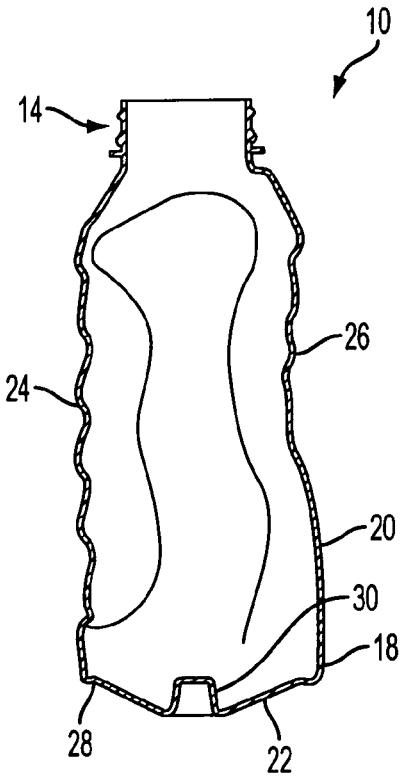
FIG. 6 is a cross-sectional view of the plastic container of FIG. 1 taken along line A-A of FIG. 3, shown with a pressure panel in an initial position.
Figure 7:
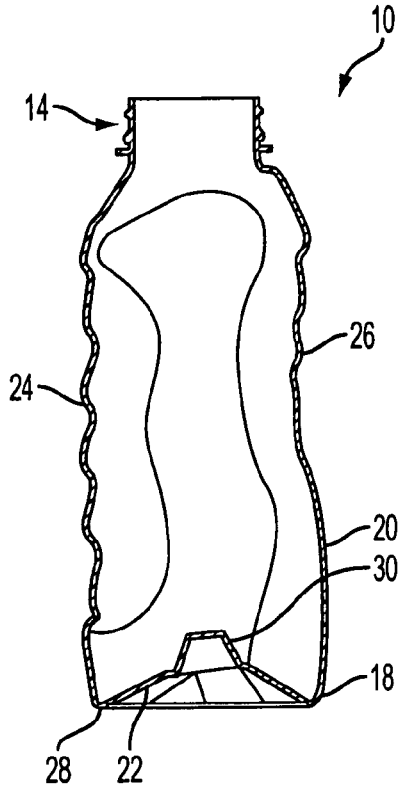
FIG. 7 is a cross-sectional view of the plastic container of FIG. 1 taken along line A-A of FIG. 3, shown with the pressure panel in an activated position.

Referring to FIGS. 5-7, base 18 can include a standing ring 28. Pressure panel 22 can be in the form of an invertible panel that extends from the standing ring 28 to the approximate center of the base 18. In the exemplary embodiment shown, pressure panel 22 is faceted and includes a push-up 30 proximate its center, although other configurations of pressure panel 22 are possible. Standing ring 28 can be used to support container 10, for example on a relatively flat surface, after the pressure panel 22 is activated.

Pressure panel 22 can be activated by moving it from an initial position (shown in FIG. 6) in which the pressure panel 22 extends outward from container 10, to an activated position (shown in FIG. 7) in which the pressure panel 22 extends inward into the interior volume of the container 10. In the exemplary embodiment shown in FIGS. 5-7, moving pressure panel 22 from the initial position to the activated position effectively reduces the internal volume of container 10. This movement can be performed by an external force applied to container 10, for example, by pneumatic or mechanical means.

Container 10 can be filled with the pressure panel 22 in the initial position, and then the pressure panel 22 can be moved to the activated position after container 10 is filled and sealed, causing a reduction in internal volume in container 10. This reduction in the internal volume can create a positive pressure inside container 10. For example, the reduction in internal volume can compress the headspace in the container, which in turn will exert pressure back on the liquid contents and the container walls. It has been found that this positive pressure reinforces container 10, and in particular, stiffens sidewall 20 as compared to before the pressure panel 22 is activated. Thus, the positive pressure created as a result of pressure panel 22 allows plastic container 10 to have a relatively thin sidewall yet have substantial portions that are free of structural reinforcements as compared to prior art containers. One of ordinary skill in the art will appreciate that pressure panel 22 may be located on other areas of container 10 besides base 18, such as sidewall 20. In addition, one of ordinary skill in the art will appreciate that the container can have more than one pressure panel 22, for example, in instances where the container is large and/or where a relatively large positive pressure is required inside the container.

Figure 6A:
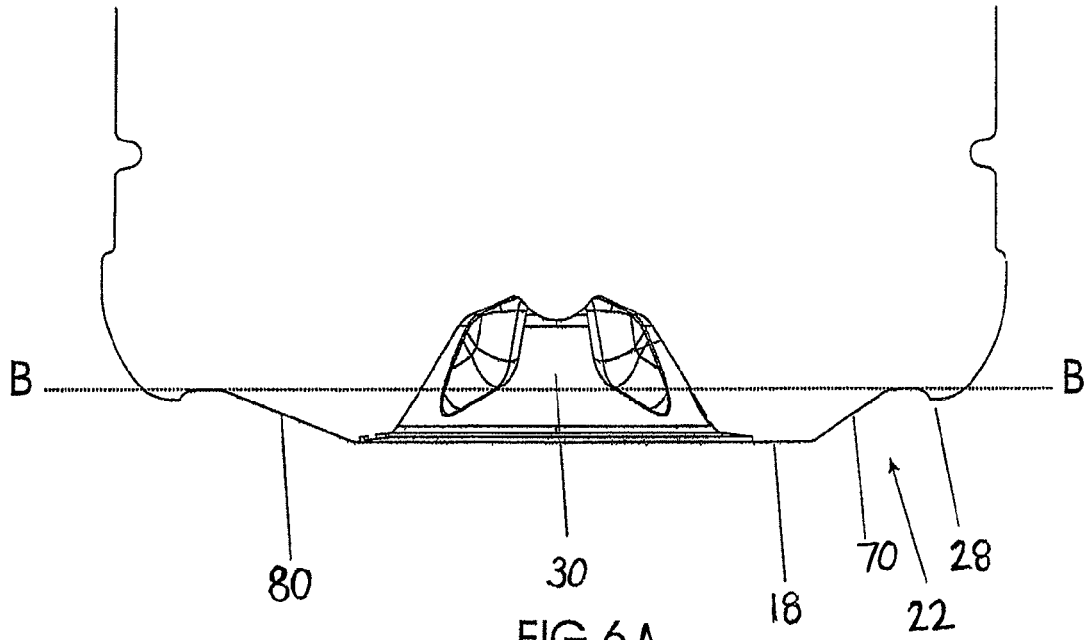
FIG. 6A is a schematic cross-sectional view of a pressure panel in the base of a plastic container such as that shown in the embodiment depicted in FIG. 6 prior to inversion of the pressure panel from the initial position to the activated position.
Figure 7A:
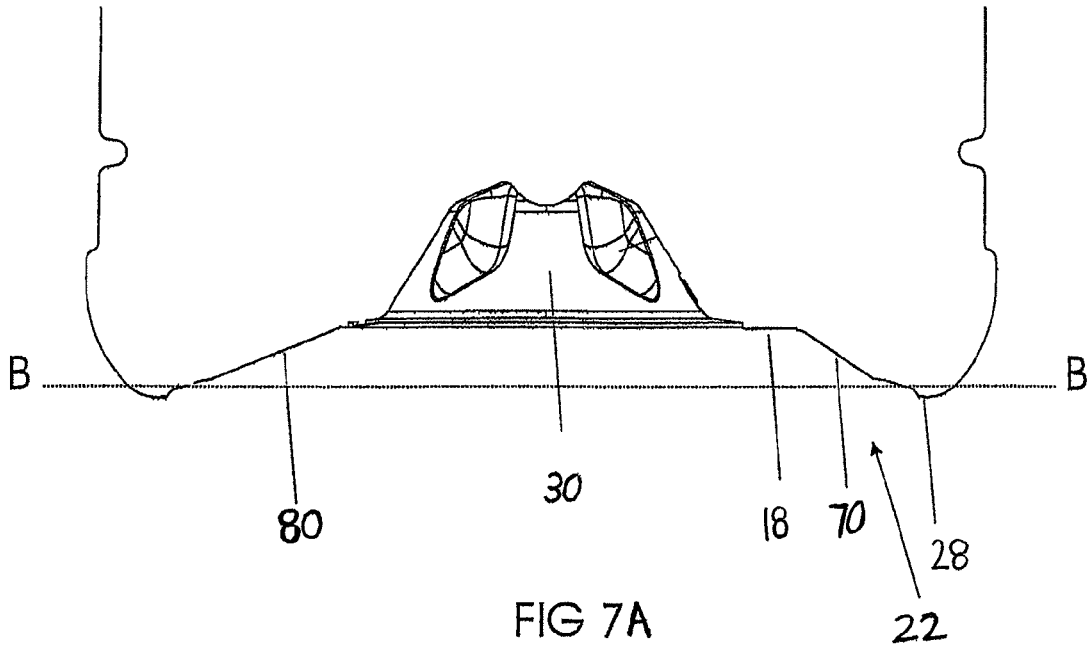
FIG. 7A is a schematic cross-sectional view of the pressure panel in the base of a plastic container such as that shown in the embodiment depicted in FIG. 7 after inversion of the pressure panel from the initial position to the activated position.

The size and shape of pressure panel 22 can depend on several factors. For example, it may be determined for a specific container that a certain level of positive pressure is required to provide the desired strength characteristics (e.g., hoop strength and top load capacity). The pressure panel 22 can thus be shaped and configured to reduce the internal volume of the container 10 by an amount that creates the predetermined pressure level. For containers that are filled at ambient temperature, the predetermined amount of pressure (and/or the amount of volume reduction by pressure panel 22) can depend at least on the strength/flexibility of the sidewall, the shape and/or size of the container, the density of the liquid contents, the expected shelf life of the container, and/or the amount of headspace in the container. Another factor to consider may be the amount of pressure loss inside the container that results from vapor loss during storage of the container. Yet another factor may be volume reduction of the liquid contents due to refrigeration during storage. For containers that are "hot filled" (i.e., filled at an elevated temperature), additional factors may need to be considered to compensate for the reduction in volume of the liquid contents that often occurs when the contents cool to ambient temperature (and the accompanying vacuum that may form in the container). These additional factors can include at least the coefficient of thermal expansion of the liquid contents, the magnitude of the temperature changes that the contents undergo, and/or water vapor transmission. By considering all or some of the above factors, the size and shape of pressure panel 22 can be calculated to achieve predictable and repeatable results. To allow for increased evacuation of vacuum it will be appreciated that it is preferable to provide a steep angle to a control portion 70 of the pressure panel 22. As shown in FIG. 6A, for example, the control portion 70 of the panel 22 may be set with an angle varying between 30 degrees and 45 degrees relative to a plane B-B oriented perpendicular to the longitudinal axis of the container. It is preferable to ensure an angle is set above 10 degrees at least. An initiator portion 80 of the pressure panel 22 may, in this embodiment, have a lesser angle of perhaps at least 10 degrees less than the control portion 70. By way of example, it will be appreciated that when the pressure panel 22 is inverted by mechanical compression (see FIG. 8*c*), it will undergo an angular change that is double that provided to it. For example, if the conical control portion 70 is set to 10 degrees it will provide a panel change equivalent to 20 degrees when inverted. At such a low angle, however, it has been found to provide an inadequate amount of vacuum compensation in a hot-filled container. Therefore, it is preferable to provide much steeper angles. Referring to FIGS. 6A and 7A, it will be appreciated that the control portion 70 may be initially set to be outwardly inclined by approximately 35 degrees and will then provide an inversion and angle change of approximately 70 degrees. The initiator portion 80 may in this example be 20 degrees. It should be noted that the positive pressure inside the container 10 is not a temporary condition, but rather, should last for at least 60 days after the pressure panel is activated, and preferably, until the container 10 is opened.

Figure 8C:
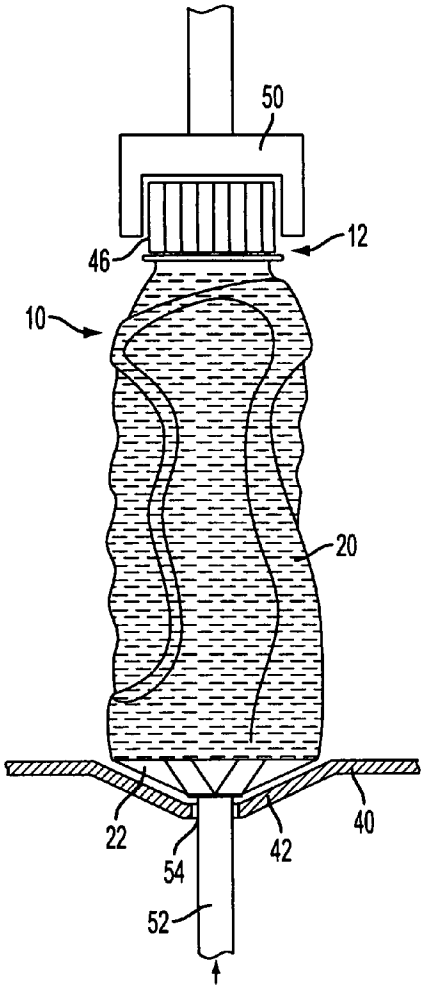
FIGS. 8A-8C schematically represent the steps of an exemplary method of processing a container according to the present invention.
Figure 8B:
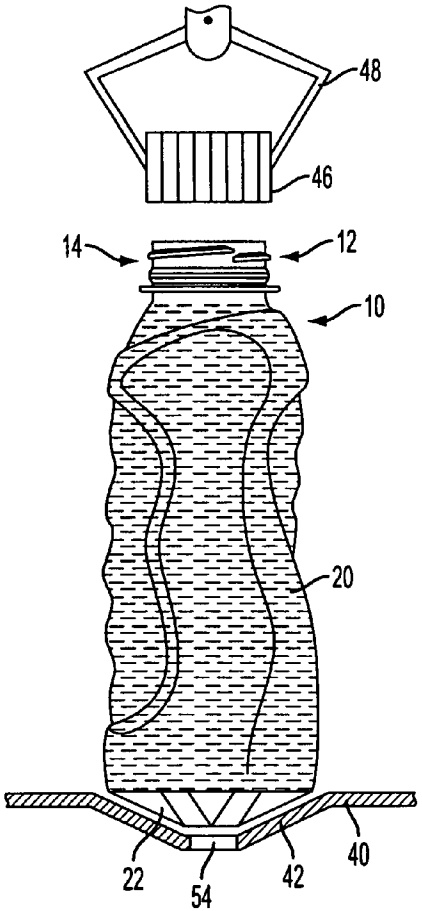
Figure 8A:
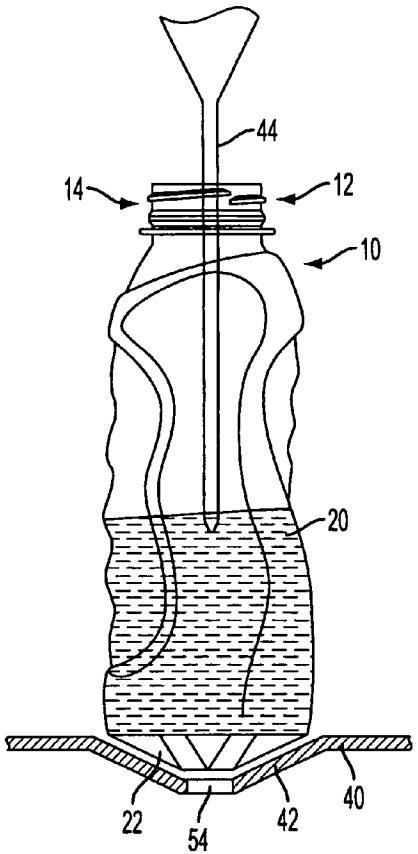

Referring to FIGS. 8A-8C, an exemplary method of processing a container according to the present invention is shown. The method can include providing a container 10 (such as described above) having the pressure panel 22 in the initial position, as shown in FIG. 8A. The container 10 can be provided, for example, on an automated conveyor 40 having a depressed region 42 configured to support container 10 when the pressure panel 22 is in the initial, outward position. A dispenser 44 is inserted into the opening in the upper portion 12 of the container 10, and fills the container 10 with liquid contents. For certain liquid contents (e.g., juices), it may be desirable to fill the container 10 with the contents at an elevated temperature (i.e., above ambient temperature). Once the liquid contents reach a desired fill level inside container 10, the dispenser 44 is turned off and removed from container 10. As shown in FIG. 8B, a closure, such as a cap 46, can then be attached to the container's finish 14, for example, by moving the cap 46 into position and screwing it onto the finish 14 with a robotic arm 48. One of ordinary skill in the art will appreciate that various other techniques for filling and sealing the container 10 can alternatively be used.

Once the container 10 is filled and sealed, the pressure panel 22 can be activated by moving it to the activated position. For example, as shown in FIG. 8C, a cover 50, arm, or other stationary object may contact cap 46 or other portion of container 10 to immobilize container 10 in the vertical direction. An activation rod 52 can engage pressure panel 22, preferably proximate the push-up 30 (shown in FIG. 7) and move the pressure panel 22 to the activated position (shown in FIG. 7). The displacement of pressure panel 22 by activation rod 52 can be controlled to provide a predetermined amount of positive pressure, which, as discussed above, can depend on various factors such as the strength/flexibility of the sidewall 20, the shape and/or size of the container, etc.

In the exemplary embodiment shown in FIG. 8C, the activation rod 52 extends through an aperture 54 in conveyor 40, although other configurations are possible. In the case where the liquid contents are filled at an elevated temperature, the step of moving the pressure panel 22 to the inverted position can occur after the liquid contents have cooled to room temperature.

As discussed above, moving the pressure panel 22 to the activated position reduces the internal volume of container 10 and creates a positive pressure therein that reinforces the sidewall 20. As also discussed above, the positive pressure inside container 10 can permit at least a substantial portion of sidewall 20 to be free of structural reinforcements, as compared to prior art containers.

Figure 9:
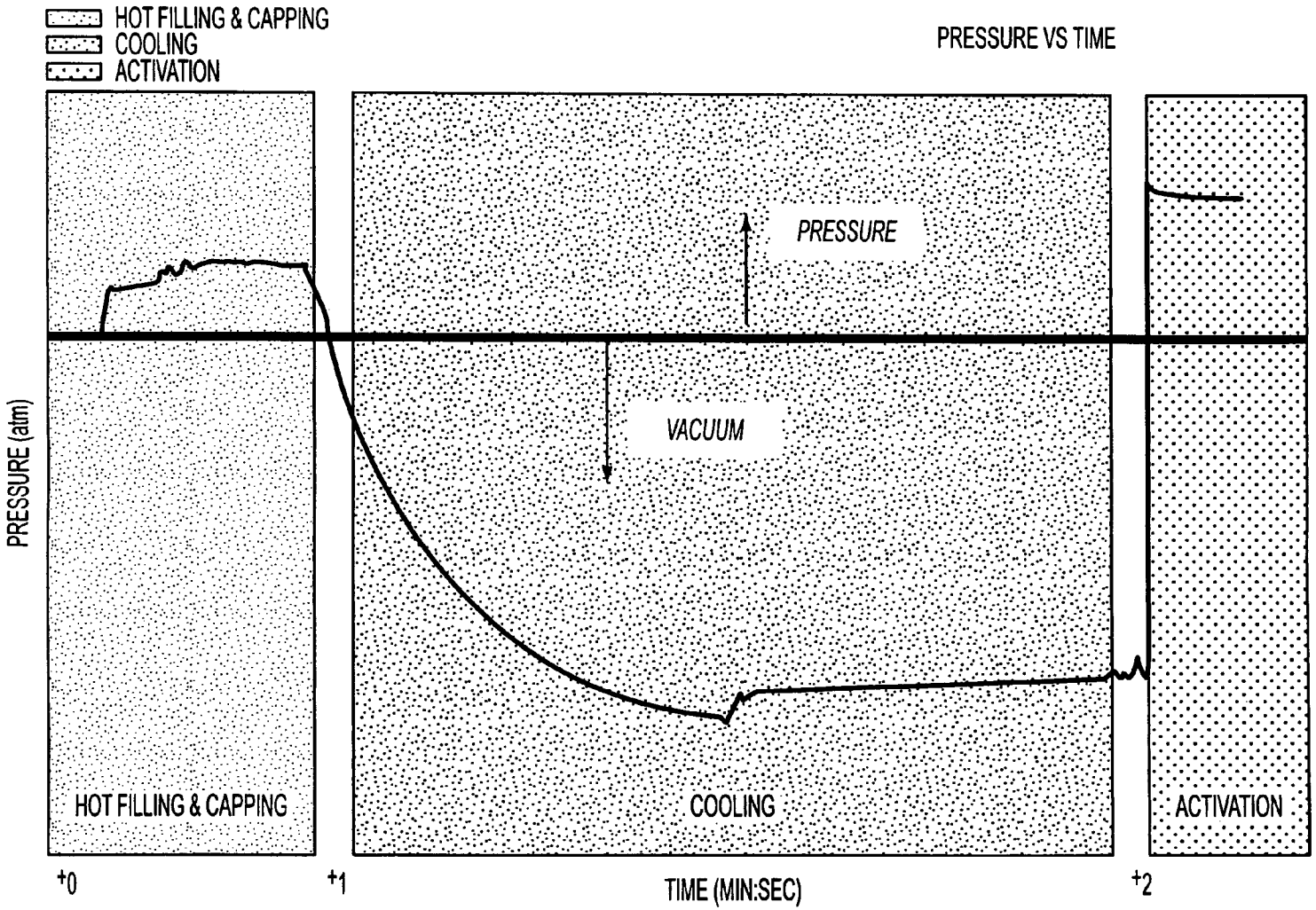
FIG. 9 is a pressure verses time graph for a container undergoing a method of processing a container according to the present invention.

FIG. 9 is a graph of the internal pressures experienced by a container undergoing an exemplary hot-fill process according to the present invention, such as a process similar to the one described above in connection with FIGS. 8A-C. When the container is initially hot filled and capped, at time $t_0$, a positive pressure exists within the sealed container, as shown on the left side of FIG. 9. After the container has been hot filled and capped, it can be left to cool, for example, to room temperature, at time $t_1$. This cooling of the liquid contents usually causes the liquid contents to undergo volume reduction, which can create a vacuum (negative pressure) within the sealed container, as represented by the central portion of FIG. 9. This vacuum can cause the container to distort undesirably. As discussed previously, the pressure panel can be configured and dimensioned to reduce the internal volume of the container by an amount sufficient to eliminate the vacuum within the container, and moreover, to produce a predetermined amount of positive pressure inside the container. Thus, as shown on the right side of the graph in FIG. 9, when the pressure panel is activated, at time $t_2$, the internal pressure sharply increases until it reaches the predetermined pressure level. From this point on, the pressure preferably remains at or near the predetermined level until the container is opened.

Referring to FIGS. 10-13, additional containers according to the present invention are shown in side view. Similar to container 10 of FIGS. 1-7, containers 110, 210, and 310 generally include an upper portion 112, 212, 312, 412 including a finish 114, 214, 314, 414 adapted to receive a closure. The containers 110, 210, 310, 410 also include a lower portion 116, 216, 316, 416 including a base 118, 218, 318, 418, and a sidewall 120, 220, 320, 420 extending between the upper portion and lower portion. The upper portion, lower portion, and sidewall generally define an interior volume of the container. Similar to container 10 of FIGS. 1-7, containers 110, 210, 310, and 410 can each include a pressure panel (see pressure panel 422 shown in FIG. 13; the pressure panel is not visible in FIGS. 10-12) that can be activated to reduce the internal volume of the container, as described above.

Containers according to the present invention may have sidewall profiles that are optimized to compensate for the pressurization imparted by the pressure panel. For example, containers 10, 110, 210, 310, and 410, and particularly the sidewalls 20, 120, 220, 320, 420, may be adapted to expand radially outwardly in order to absorb some of the pressurization. This expansion can increase the amount of pressurization that the container can withstand. This can be advantageous, because the more the container is pressurized, the longer it will take for pressure loss (e.g., due to vapor transmission through the sidewall) to reduce the strengthening effects of the pressurization. The increased pressurization also increases the stacking strength of the container.

Figure 12:
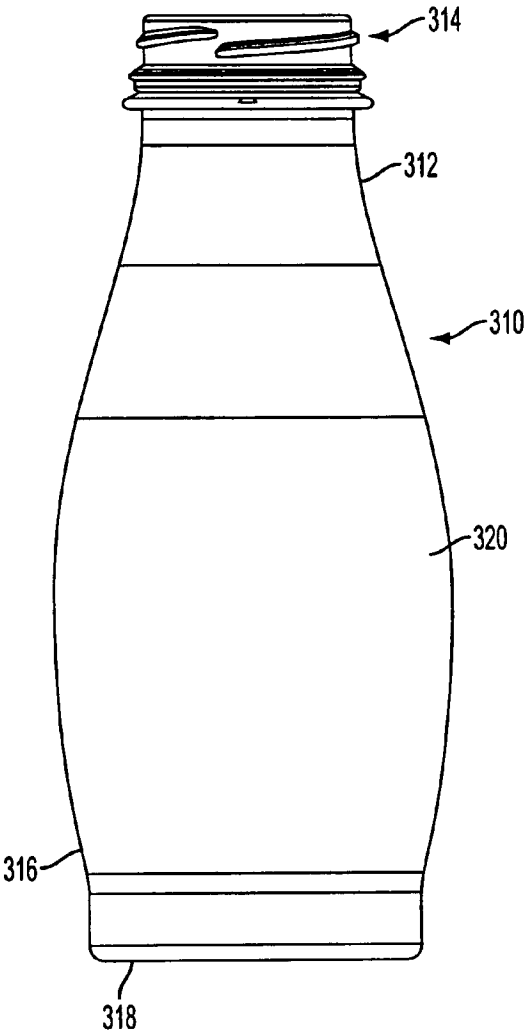
FIG. 12 is a side view of another alternative embodiment of a plastic container according to the present invention.
Figure 11:
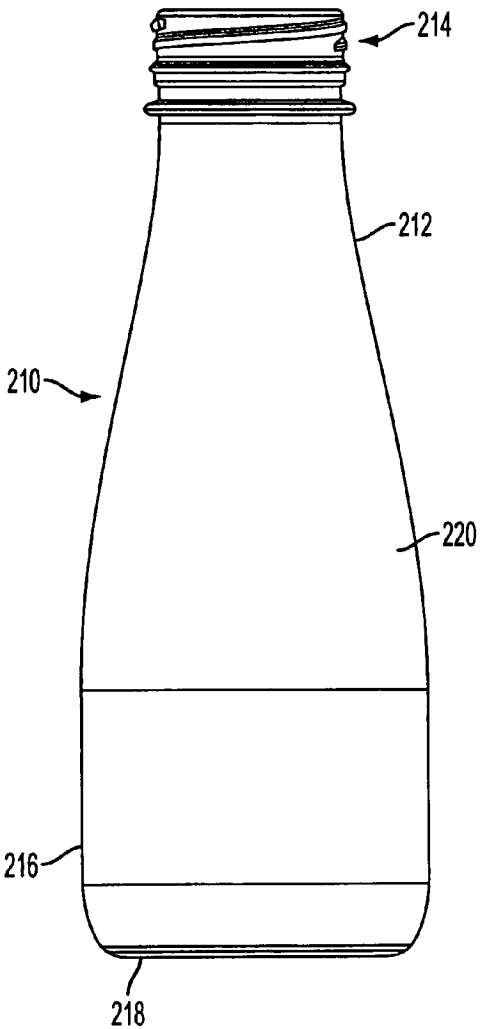
FIG. 11 is a side view of another alternative embodiment of a plastic container according to the present invention.
Figure 10:
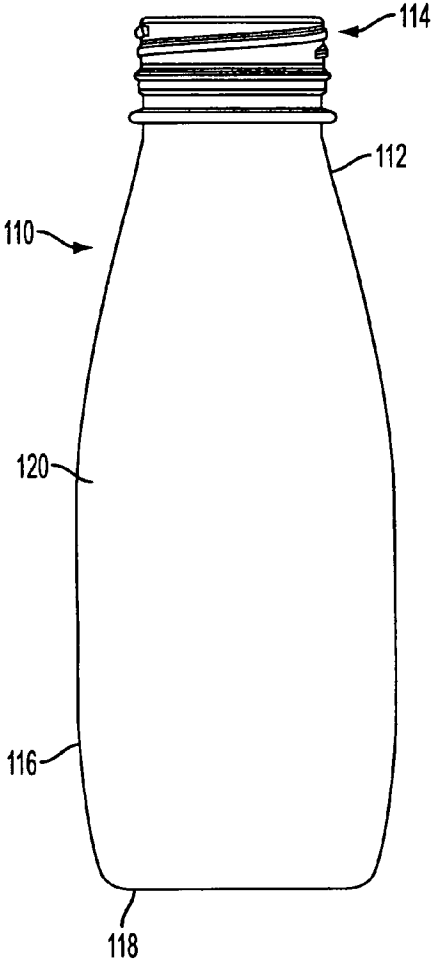
FIG. 10 is a side view of an alternative embodiment of a plastic container according to the present invention.

Referring to FIGS. 10-12, it has been found that containers including a vertical sidewall profile that is teardrop shaped or pendant shaped (at least in some vertical cross-sections) are well suited for the above-described radial-outward expansion. Referring to FIG. 4, other vertical sidewall profiles including a S-shaped or exaggerated S-shaped bend may be particularly suited for radial-outward expansion as well, although other configurations are possible.

Figure 13:
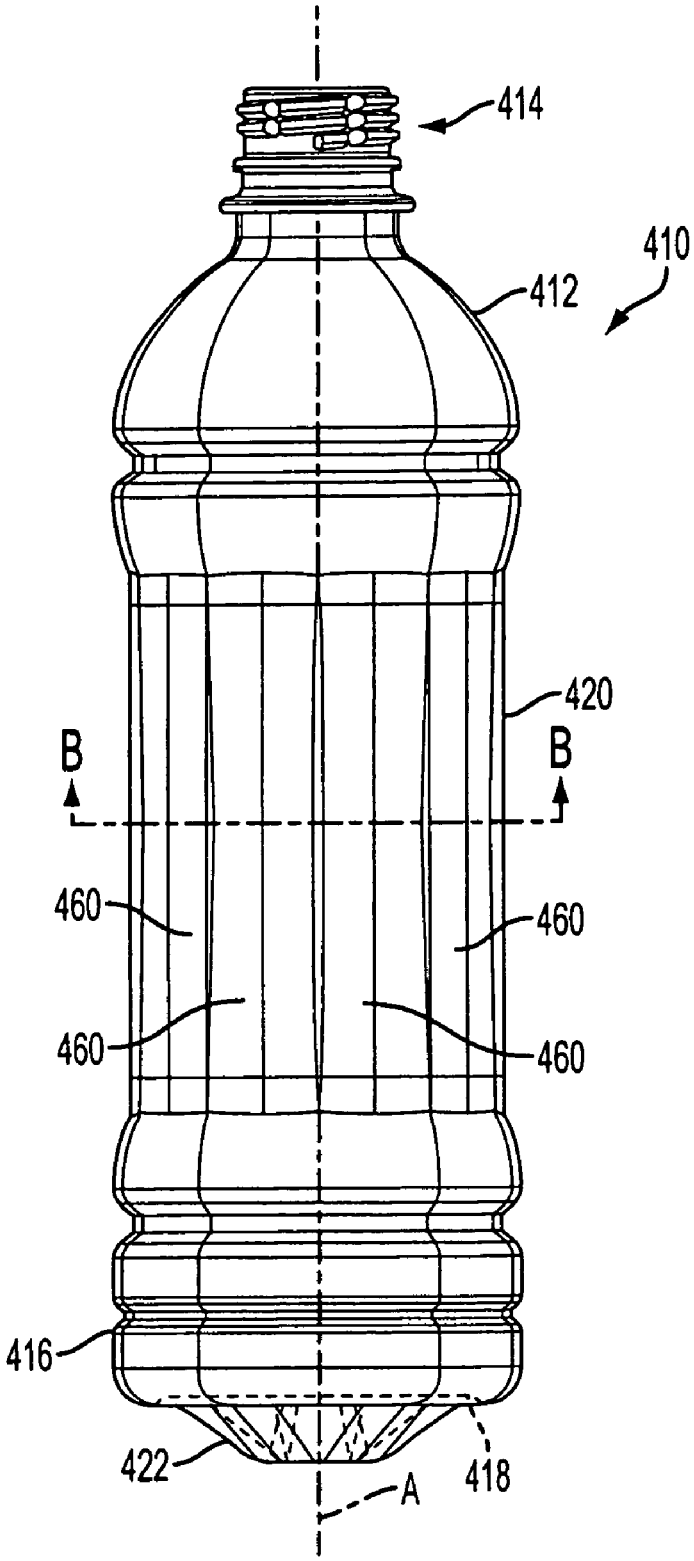
FIG. 13 is a side view of yet another alternative embodiment of a plastic container according to the present invention.
Figure 14A:
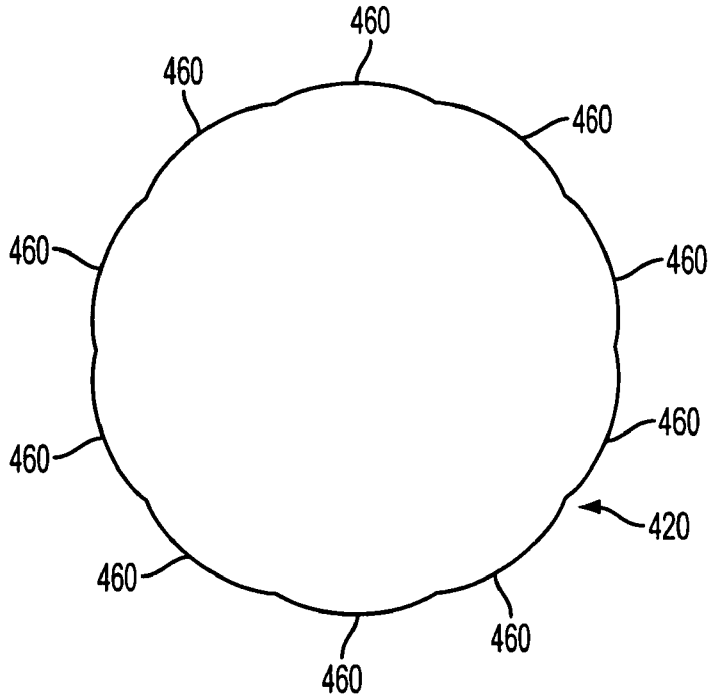
FIG. 14A is a cross-sectional view of the plastic container of FIG. 13, taken along line B-B of FIG. 13, prior to filling and capping the container.

Referring to FIGS. 13-14, it has also been found that containers having a sidewall that is fluted (at least prior to filling, capping, and activating the pressure panel) are well suited for the above-described radial-outward expansion. For example, the sidewall 420 shown in FIG. 13 can include a plurality of flutes 460 adapted to expand radially-outwardly under the pressure imparted by the pressure panel 422. In the exemplary embodiment shown, the flutes 460 extend substantially vertically (i.e., substantially parallel to the container's longitudinal axis A), however other orientations of the flutes 460 are possible. The exemplary embodiment shown includes ten flutes 460 (visible in the cross-sectional view of FIG. 14A), however, other numbers of flutes 460 are possible.

Figure 14B:
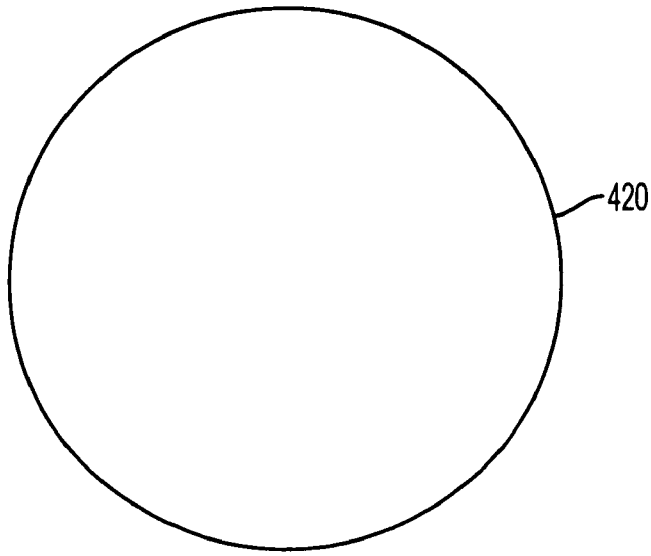
FIG. 14B is a cross-sectional view of the plastic container of FIG. 13, taken along line B-B of FIG. 13, after filling, capping, and activating the container.

FIG. 14A is a cross-sectional view of the sidewall 420 prior to activating the pressure panel 422. As previously described, activating the pressure panel 422 creates a positive pressure within the container. This positive pressure can cause the sidewall 420 to expand radially-outwardly in response to the positive pressure, for example, by reducing or eliminating the redundant circumferential length contained in the flutes 460. FIG. 14B is a cross-sectional view of the sidewall 420 after the pressure panel has been activated. As can be seen, the redundant circumferential length previously contained in the flutes 460 has been substantially eliminated, and the sidewall 420 has bulged outward to assume a substantially circular cross-section.

One of ordinary skill in the art will know that the above-described sidewall shapes (e.g., teardrop, pendant, S-shaped, fluted) are not the only sidewall configurations that can be adapted to expand radially outwardly in order to absorb some of the pressurization created by the pressure panel. Rather, one of ordinary skill in the art will know from the present application that other shapes and configurations can alternatively be used, such as concertina and/or faceted configurations.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

What is claimed is:

1. A pressure reinforced plastic container having a longitudinal axis, comprising:

a neck defining an open top, the neck including a finish adapted to receive a cap for closing the open top;

a closed base oppositely disposed from the open top, the closed base comprising:

an outer annular edge;

a central cavity;

a flexible annular pressure panel extending between the outer annular edge and the central cavity;

a sidewall extending upward from the outer annular edge of the closed base to the neck, the closed base and the sidewall defining an interior volume for storing liquid contents;

wherein the pressure panel is movable between an initial convex exterior position and an activated concave exterior position, wherein the pressure panel includes a first portion inclined outwardly at an angle of greater than 10 degrees relative to a plane orthogonal to the longitudinal axis when the pressure panel is in the initial position, wherein the pressure panel is in the initial position prior to filling the container with the liquid contents and is moved to the activated position after filling and sealing the container; and, wherein the pressure panel is adapted to receive an external force moving the pressure panel from the initial position to the activated position, such that when moving the pressure panel from the initial position to the activated position, the interior volume of the container is reduced and an increased pressure is created inside the container, and the increased pressure reinforces the sidewall.

2. The plastic container of claim 1, wherein a headspace exists in the container after filling and sealing, and moving the pressure panel from the initial position to the activated position compresses the headspace.

3. The plastic container of claim 1, wherein the sidewall defines a vertical profile that is approximately teardrop shaped or approximately pendant shaped.

4. The plastic container of claim 1, wherein the sidewall defines a generally circular cross-section.

5. The plastic container of claim 1, wherein the sidewall includes a grip portion.

6. The plastic container of claim 1, wherein the pressure panel extends outward from the container when in the initial position, and the pressure panel extends inward into the interior volume of the container when in the activated position.

7. The plastic container of claim 1, wherein the pressure panel is located in the base.

8. The plastic container of claim 1, wherein the liquid contents are hot filled.

9. The plastic container of claim 1, wherein a second portion of the pressure panel is inclined outwardly at an angle, relative to the plane orthogonal to the longitudinal axis, at least 10 degrees less than that of the first portion of the pressure panel when the pressure panel is in the initial position.

10. The plastic container of claim 1, wherein the pressure panel is adapted to reduce a predetermined amount of volume inside the container when in the activated position.

11. The plastic container of claim 10, wherein the predetermined amount of volume reduction is calculated based at least partially on strength characteristics of the sidewall.

12. The plastic container of claim 10, wherein the predetermined amount of volume reduction is calculated based at least partially on coefficient of thermal expansion characteristics of the liquid contents.

13. The plastic container of claim 10, wherein the predetermined amount of volume reduction is calculated based at least partially on the rate of vapor transmission through the sidewall.

14. The plastic container of claim 1, wherein the first portion of the pressure panel is inclined outwardly at an angle of greater than 10 degrees and less than 45 degrees relative to a plane orthogonal to the longitudinal axis when the pressure panel is in the initial position.

15. The plastic container of claim 14, wherein the first portion of the pressure panel is inclined outwardly at an angle of between 30 degrees and 45 degrees relative to a plane orthogonal to the longitudinal axis when the pressure panel is in the initial position.

16. The plastic container of claim 15, wherein the first portion of the pressure panel is inclined outwardly at an angle of approximately 35 degrees relative to a plane orthogonal to the longitudinal axis when the pressure panel is in the initial position.

17. The plastic container according to claim 1, wherein the increased pressure is a positive pressure relative to the pressure inside the container prior to sealing.

18. The plastic container of claim 17, wherein the pressure panel is sized and shaped to reduce the internal volume of the container by an amount that creates a predetermined level of the positive pressure in the container to reinforce the sidewall and provide desired strength characteristics, and wherein the container is configured to maintain the positive pressure in the container at or near the predetermined level until the container is opened.

19. The plastic container of claim 17, wherein the positive pressure has moved the sidewall radially outward from an initial position to a radially further outward reinforced position.

20. The plastic container of claim 17, wherein the sidewall is adapted to expand radially outwardly due to the positive pressure.

21. The plastic container of claim 17, wherein a substantial portion of the sidewall is free of structural reinforcement elements, and the positive pressure is sufficient to support the sidewall.

22. The plastic container of claim 17, wherein the positive pressure inside the container is maintained for at least 60 days after the pressure panel is moved to the activated position.

23. The plastic container of claim 17, wherein the sidewall comprises a plurality of flutes adapted to expand radially outwardly due to the positive pressure.

24. The plastic container of claim 23, wherein the plurality of flutes extend substantially parallel to the longitudinal axis.

* * * * *